United States Patent [19]

Nishijima et al.

[11] Patent Number: 4,870,851

[45] Date of Patent: Oct. 3, 1989

[54] APPARATUS FOR PRODUCING STRANDED CABLE

[75] Inventors: Tamotsu Nishijima; Toshihiro Fujino, both of Numazu, Japan

[73] Assignee: Yazaki Corporation, Tokyo, Japan

[21] Appl. No.: 288,731

[22] Filed: Dec. 23, 1988

[51] Int. Cl.[4] ..... B21C 23/08

[52] U.S. Cl. ..... 72/261; 72/262

[58] Field of Search ..... 72/91, 261, 262

[56] References Cited

U.S. PATENT DOCUMENTS

| | | | |
|---|---|---|---|
| 3,466,911 | 9/1969 | Marcovitch | 72/91 |
| 4,065,950 | 1/1978 | Green | 72/262 |
| 4,471,527 | 9/1984 | Nishijima | 72/261 |

OTHER PUBLICATIONS

Yazaki Technical Report, Dec. 28, 1987, "Development of Direct Stranding Process".

*Primary Examiner*—Lowell A. Larson

*Attorney, Agent, or Firm*—Armstrong, Nikaido, Marmelstein, Kubovcik & Murray

[57] ABSTRACT

A novel apparatus for producing a stranded cable which is simplified in construction, easy to assemble and high in efficiency. The apparatus comprises a rotatable member having an annular groove formed in an outer periphery thereof, a plurality of dies disposed on a single circumferential line on an axial end face of the rotatable member, and an annular shoe having an outer periphery for engaging in the annular groove of the rotatable member. The annular shoe is supported for rotation in an eccentric relationship to the rotatable member such that the outer periphery of the annular shoe is partially engaged in the annular groove of the rotatable member to define therebetween a wire stock passageway having a varying sectional area. Wire stock is supplied into the wire stock passageway at a portion having a relatively greater sectional area and is then successively extruded from the dies on the rotatable member at or near another portion of the wire stock passageway having a minimum sectional area to form wires, and the wires thus formed are subsequently stranded into a stranded cable.

4 Claims, 3 Drawing Sheets

APPARATUS FOR PRODUCING STRANDED CABLE

BACKGROUND OF THE INVENTION

1. Field of the Invention

This invention relates to an apparatus for producing a stranded cable for an electric wire or cable.

2. Description of the Prior Art

Conventionally, such an apparatus as shown in FIGS. 3 and 4 is known as an apparatus for producing a stranded cable. Referring to FIGS. 3 and 4, the apparatus shown includes a driven wheel 14 having an annular recess or groove 15 formed on an outer periphery thereof. An annular stationary shoe member 17 is disposed on the outer periphery of the driven wheel 14 and has an inner circumferential face which serves as a guide face for rotation of the driven wheel 14. The stationary shoe member 17 has an annular inward projection or flange 19 formed on the inner circumferential face thereof, and the annular projection 19 extends into the annular groove 15 of the driven wheel 14 to define a passageway 21 for wire stock 20 fed thereto by way of a supply passageway 18.

The supply passageway 18 is formed in the stationary shoe member 17 for supplying wire stock 20 as a rough drawing wire therethrough into the passageway 21, and a guide roller 22 is disposed adjacent the supply passageway 18. An inner periphery 19*a* of the annular projection 19 of the stationary shoe member 17 gradually approaches an outer surface 15*a* of the annular groove 15 of the driven wheel 14 in the direction of rotation of the driven wheel 14 from the supply passageway 18 so that the sectional area of the passageway 21 defined by inner walls of the annular groove 15 and the annular projection 19 may gradually decrease in the counterclockwise direction in FIG. 4 from the position of the guide roller 22.

The driven wheel 14 has an axial center bore 23 formed therein, and a plurality of dies 26 are disposed in a concentrical relationship around the axial center bore 23 of the driven wheel 14 adjacent the passageway 21 which is defined by the inner walls of the annular groove 15 of the driven wheel 14 and the annular projection 19 of the stationary shoe member 17. In particular, threaded bores 25 are formed in parallel to the axial center bore 23 in a front end portion 24 of the driven wheel 14 and communicate with the passageway 21. A die holder 27 having an orifice 28 formed therein is threaded in each of the threaded bores 25, and a die 26 is supported at an end portion of each of the die holders 27 adjacent the passageway 21.

With the apparatus having such a construction as described above, rough drawing wire stock 20 is supplied into the passageway 21 through the supply path 18 of the stationary shoe member 17 past the guide roller 22 and is then advanced in the passageway 21 of the driven wheel 14 due to frictional force thereof with the latter as the driven wheel 14 rotates. During such advancement of the rough drawing wire stock 20, it is compressed by the driven wheel 14 and the stationary shoe member 17 as the sectional area of the passageway 21 gradually decreases. Then, when a predetermined compression stress is reached, the rough drawing wire stock 20 is successively extruded from the dies 26 adjacent the passageway 21 to form wires 33 having a desired diameter. Each of the wires 33 thus formed then passes two successive tension adjusting rollers 29 which are driven to rotate along with the driven wheel 14 while it is maintained under a predetermined constant tension by the tension adjusting rollers 29. In the meantime, a core wire 32 is supplied through the axial center bore 23 of the driven wheel 14. The wires 33 and the core wire 32 then pass through a twisting plate 30 and are then twisted with each other by a twisting die 31 to form a concentric lay cable 34 of a single layer. The cable 34 is successively wound up on a take-up drum not shown by way of a capstan.

Upon such conventional extrusion molding which employs a frictional force, since the wire stock between the driven wheel and the stationary shoe is acted upon by frictional forces in the opposite directions and besides the inner face of the annular projection of the stationary shoe has an irregular configuration, it is a drawback that a high production cost is required. Further, since the annular projection of the stationary shoe is fitted over the entire periphery thereof in the annular groove of the driven wheel, it is necessary, upon assembly of the apparatus, to divide either the stationary shoe or the driven wheel. Accordingly, also it is a drawback that much time is required for maintenance.

SUMMARY OF THE INVENTION

It is an object of the present invention to provide a novel apparatus for producing a stranded cable which is simplified in construction, easy to assemble and high in efficiency.

In order to attain the object, according to the present invention, an apparatus for producing a stranded cable comprises a rotatable member mounted for rotation around a fixed axis and having an annular recessed groove formed in an outer periphery thereof, a plurality of dies disposed on a single circumferential line on an axial end face of the rotatable member, an annular shoe having a periphery of engaging in the annular recessed groove in the rotatable member, and means for suporting the annular shoe for rotation around an axis spaced from the fixed axis of the rotatable member relative to the rotatable member such that the outer periphery of the anular shoe is partially fitted in the annular recessed groove of the rotatable member to define therebetween a wire stock passageway having a varying sectional area, whereby wire stock is supplied into the wire stock passageway at a portion having a relatively greater sectional area and is then successively extruded from the dies on the rotatable member at or near another portion of the wire stock passageway having a minimum sectional area to form wires which are to be subsequently stranded into a stranded cable.

With the apparatus for producing a stranded cable, since the rotatable member is disposed such that the center axis of rotation thereof is displaced from the center axis of rotation of the annular shoe and the shoe itself which cooperates with the rotatable member to define the wire stock passageway therebetween is also supported for rotation, the frictional force between wire stock in the wire stock passageway and inner walls defining the wire stock passageway and contacting with the wire stock can be reduced significantly, and consequently, power for driving the apparatus can be saved. Besides, the shoe which is disposed in an opposing relationship to the driven wheel need not have a special configuration as in the conventional arrangement described hereinabove, and consequently, the production cost can be reduced. Furthermore, since the driven wheel and the shoe are not engaged over the entire peripheries thereof with each other as in the conventional arrangement, neither the driven wheel nor the shoe need be divided into a plurality of parts to facilitate assembly, and accordingly the number of manhours required for maintenance can be reduced.

Further, since the inner periphery of the shoe is fitted only partially in the annular recessed groove of the driven wheel, stock which is discharged from the machine as a loss (normally called flash) other than products will not be produced over the entire periphery of the driven wheel but will escape to the open side of the wire stock passageway forwardly of the portion of the wire stock passageway which presents the minimum sectional area. Accordingly, such flash is minimized.

In addition, where the annular shoe is positively driven to rotate around its axis, the stranding pitch of the product can be adjusted to an arbitrary length.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
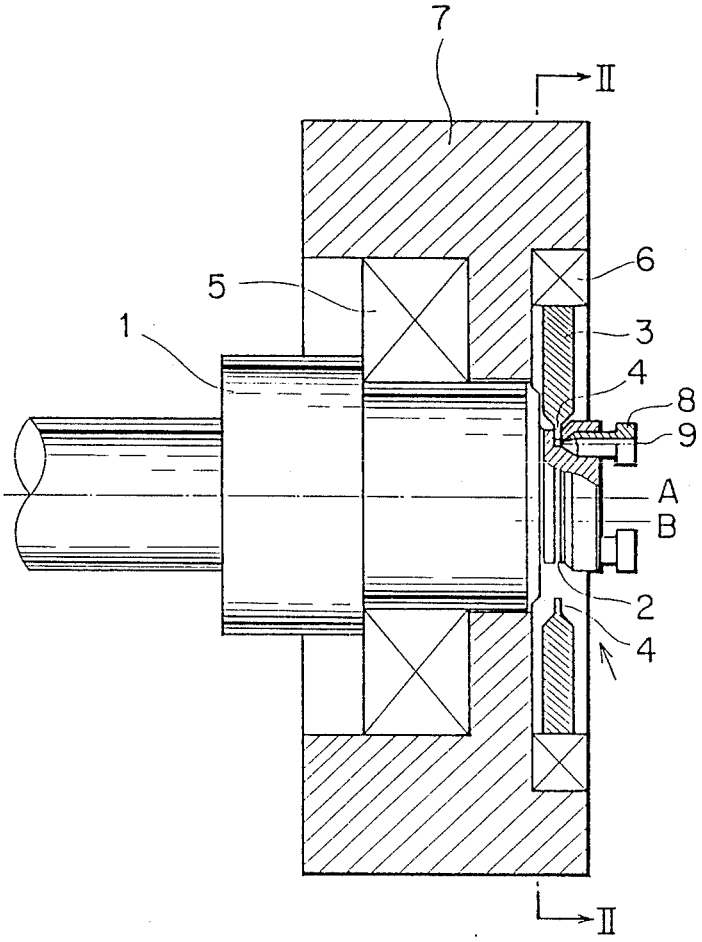
FIG. 1 is a vertical sectional view of an apparatus for producing a stranded cable showing a preferred embodiment of the present invention.
Figure 2:
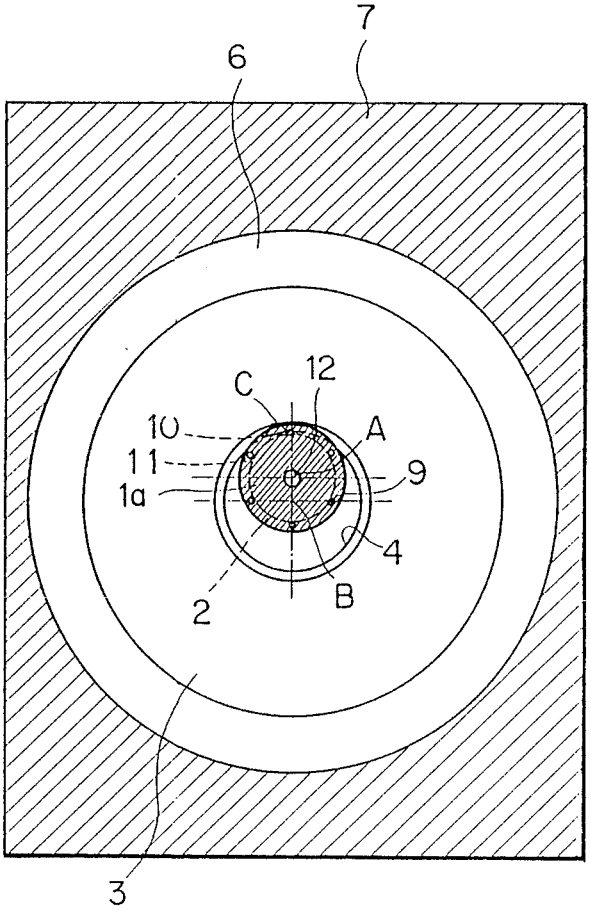
FIG. 2 is a sectional view taken along line II—II of FIG. 1.
Figure 3:
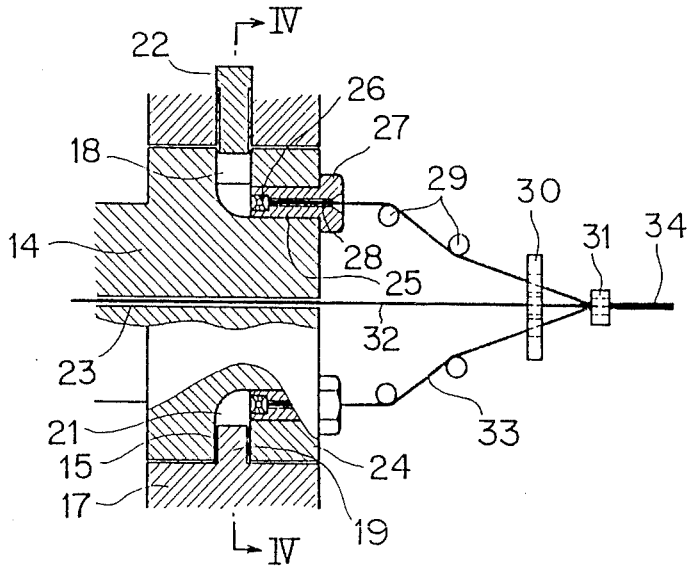
FIG. 3 PRIOR ART
FIG. 3 is a vertical sectional view of a conventional apparatus for producing a stranded cable.
Figure 4:
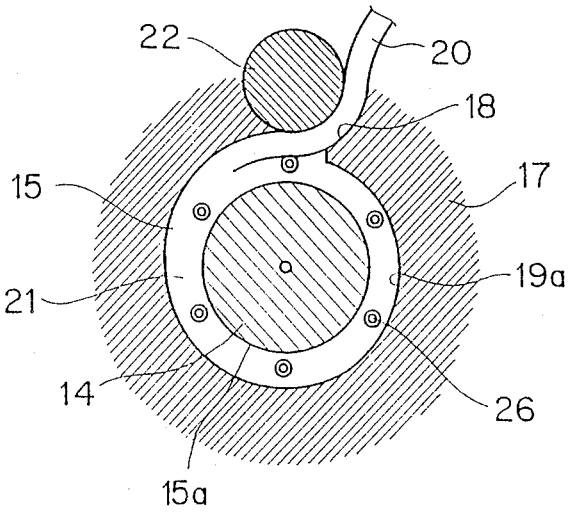
FIG. 4 PRIOR ART
FIG. 4 is a sectional view taken along line IV—IV of FIG. 3.

Referring to FIGS. 1 and 2, there is shown an apparatus for producing a stranded cable according to the present invention. The apparatus includes a driven wheel or rotatable member 1 supported for rotation on a machine frame 7 by means of a bearing 5 and connected to be driven by a power source not shown. The driven wheel 1 has an annular recessed groove 2 formed at an end portion 1*a* thereof. An annular shoe 3 is supported around the rotatable member for free rotation on the machine frame 7 by means of a bearing 6 and has an annular inward projection or rib 4 formed in an inner periphery thereof in an opposing relationship to the recessed groove 2 of the driven wheel 1 such that the annular inward projection 4 may be fitted in the recessed groove 2 at the end portion 1*a* of the driven wheel 1. In particular, the driven wheel 1 and the annular shoe 3 are disposed in an eccentric relationship such that the center axis B of rotation of the latter is displaced by a predetermined distance from the center axis A of rotation of the former and the annular inner projection 4 of the annular shoe 3 is normally held in partially fitting engagement in the annular recessed groove 2 of the driven wheel 1 as seen in FIG. 2.

While the annular inward projection 4 of the annular shoe 3 is fitted in the annular recessed groove 2 of the driven wheel 1, a wire stock passageway 10 is left between the bottom of the annular recessed groove 2 and the annular inner projection 4. Because the center axes of rotation of the driven wheel 1 and the annular shoe 3 are displsed from each other, the wire stock passageway 10 has such a varying sectional area that presents a minimum value at the position C on a line interconnecting the rotational center axes A and B and gradually increases toward the opposite directions from the position C.

A plurality of dies 8 are located on an axial end face of the driven wheel 1 at equidistantly spaced positions on a circumferential line centered at the rotational center axis A of the driven wheel 1 and having a radius equal to the distance from the position A to the position C at which the wire stock passageway 10 presents a minimum sectional area. Each of the dies 8 has an orifice 9 bored along an axis therethrough.

With the apparatus for producing a stranded cable according to the present invention having such a construction as described above, if wire stock not shown is supplied into the wire stock passageway 10 from an open end 11 side of the latter while the driven wheel 1 is rotating in the clockwise direction in FIG. 2, as the driven wheel 1 rotates, the wire stock is held between inner walls of the annular recessed groove 2 of the driven wheel 1 and the annular inner projection 4 of the annular shoe 3 so that is drawn into the wire stock passageway 10 defined by the inner walls of the annular recessed groove 2 and the annular inner projection 4 to be advanced in the same direction as the direction of rotation of the driven wheel. During such advancement of the wire stock, as the wire stock passageway 10 decreases its sectional area, the pressure applied to the wire stock increases, and the wire stock thus passes a high pressure zone which exists in a predetermined range around the position C of the wire stock passageway 10. In the high pressure zone, the wire stock is successively extruded from the orifices 9 of the dies 8 to form wires of a reduced diameter.

During such a sequence of operations as described above, a frictional force caused between the annular shoe 3 and the wire stock will not disturb the movement of the wire stock to assure smooth processing of the wire stock because the annular shoe 3 is supported for free rotation by means of the bearing 6.

Part of wire stock is extruded in the form of a wire from the orifice 9 of one of the dies 8 mounted on the end face of the driven wheel 1 at the high pressure zone around the position C of the wire stock passageway 10 defined between the inner walls of the annular recessed groove 2 of the driven wheel 1 and the annular inner projection 4 of the annular shoe 3 as described above. While thereafter the stock is not subjected to pressure to be extruded from the orifice 9 of the one die 8 until the die 8 returns to the high pressure zone near the position C again, the wire stock remaining in the annular recessed groove 2 of the driven wheel 1 and the stock remaining in the orifice 9 are maintained in a continuous condition, and accordingly, connection between the wire stock and the wire of a reduced diameter is assured between the first extrusion and a subsequent next extrusion.

Since the plurality of orifices 9 formed in an equidistantly spaced relationship successively pass the high pressure zone near the position C in this manner for one full rotation of the driven wheel 1, wires of the same length are produced, and as the driven wheel 1 rotates, a stranded cable is produced from the wires.

Further, where individual wires delivered from the orifices 9 of the dies 8 and a center wire supplied from an axial center bore 12 formed through the driven wheel 1 are gathered together, a stranded cable having a core wire can be produced.

The annular shoe 3 may be either mounted for free rotation so as not to provide resistance to the wire stock as in the embodiment described above or driven to rotate by positively applying a predetermined driving force to wire stock in the direction of rotation of the driven wheel 1.

Where the annular shoe is positively rotated in this manner, a frictional force which is caused between wire stock in the wire stock passageway 10 and the inner walls of the annular recessed groove 2 of the driven wheel 1 as well as the annular inner projection 4 of the annular shoe 3 can be controlled suitably. Accordingly, it is possible to adjust the amount of extrusion from each orifice in each full rotation of the driven wheel 1 because such amount depends upon the diameter of the wire stock and the frictional force, that is, the wire length for one pitch of a stranded cable to be produced is controlled.

Having now fully described the invention, it will be apparent to one of ordinary skill in the art that many changes and modifications can be made thereto without departing from the spirit and scope of the invention as set forth herein.

What is claimed is:

1. An apparatus for producing a stranded cable, comprising a rotatable member mounted for rotation around a fixed axis and having an annular groove formed in a periphery thereof, a plurality of dies disposed on a single circumferential line on an axial end face of said rotatable member, a circular shoe having a periphery for engaging in said annular groove of said rotatable member, and means for supporting said circular shoe for rotation around an axis spaced from said fixed axis of said rotatable member relative to said rotatable member such that said periphery of said circular shoe is partially engaged in said annular groove of said rotatable member to define therebetween a wire stock passageway having a varying sectional area, whereby wire stock is supplied into said wire stock passageway at a portion having a relatively greater sectional area and is then successively extruded from said dies on said rotatable member through a portion of said wire stock passageway having a minimum sectional area to form wires which are to be subsequently stranded into a stranded cable.

2. An apparatus for producing a stranded cable according to claim 1, wherein said rotatable member has an axial bore formed therein for supplying therethrough a central wire which is to be stranded with said plurality of wires extruded from said dies.

3. An apparatus for producing a stranded cable according to claim 1, wherein said circular shoe is adapted for free running to rotate around the axis thereof.

4. An apparatus for producing a stranded cable according to claim 1, wherein said circular shoe is shaped annular to surround said rotatable member.

* * * * *